US010720288B2

(12) United States Patent
Hsieh et al.

(10) Patent No.: US 10,720,288 B2
(45) Date of Patent: Jul. 21, 2020

(54) KEYBOARD DEVICE

(71) Applicant: Chicony Electronics Co., Ltd., New Taipei (TW)

(72) Inventors: Chao-Chin Hsieh, New Taipei (TW); Yeong-Sheng Jang, New Taipei (TW); Yi-Cheng Chang, New Taipei (TW)

(73) Assignee: Chicony Electronics Co., Ltd., New Taipei (TW)

( * ) Notice: Subject to any disclaimer, the term of this patent is extended or adjusted under 35 U.S.C. 154(b) by 0 days.

(21) Appl. No.: 16/228,419

(22) Filed: Dec. 20, 2018

(65) Prior Publication Data

US 2020/0051759 A1 Feb. 13, 2020

(30) Foreign Application Priority Data

Aug. 7, 2018 (TW) ..... 107127515 A

(51) Int. Cl.

| | |
|---|---|
| ***H01H 3/12*** | (2006.01) |
| ***H01H 13/7065*** | (2006.01) |
| *H01H 13/88* | (2006.01) |
| *H01H 13/83* | (2006.01) |

(52) U.S. Cl.

CPC ..... *H01H 13/7065* (2013.01); *H01H 13/83* (2013.01); *H01H 13/88* (2013.01); *H01H 2217/01* (2013.01)

(58) Field of Classification Search

CPC ..... H01H 3/122; H01H 3/125; H01H 13/12; H01H 13/7006; H01H 13/7065; H01H 2233/034; H01H 23/02; H01H 2221/016; H01H 21/24; H01H 2221/044; H01H 13/705; H01H 13/14; H01H 13/70;

(Continued)

(56) References Cited

U.S. PATENT DOCUMENTS 6,100,482 A * 8/2000 Koma ..... H01H 3/122 200/344
2010/0025213 A1* 2/2010 Li ..... H01H 3/125 200/344

FOREIGN PATENT DOCUMENTS

| | | |
|---|---|---|
| TW | I220214 B | 8/2004 |
| TW | I408714 B | 9/2013 |
| TW | M498913 U | 4/2015 |

(Continued)

OTHER PUBLICATIONS

Office Action issued in corresponding Taiwan patent application dated Apr. 11, 2019.

*Primary Examiner* — Ahmed M Saeed
(74) *Attorney, Agent, or Firm* — Muncy, Geissler, Olds & Lowe, P.C.

(57) ABSTRACT

A keyboard device includes a bottom plate, key caps, a circuit board, reset members, and assembly structures. The bottom plate has assembly regions. The key caps are above the bottom plate and correspond to the assembly regions. The circuit board is under the key caps. The key caps are abutted by the reset members. The assembly structures are between the bottom plate and the key caps. Each assembly structure includes an assembly member and a long rod. The assembly member is on the assembly region. The long rod is on the assembly member and is capable of moving up and down relative to the bottom plate. Each key cap includes a clamp portion. The clamp portion is on the long rod. The key cap is connected to the bottom plate via the clamp portion and is swingable about the long rod relative to the bottom plate.

13 Claims, 5 Drawing Sheets

(58) Field of Classification Search
CPC ..... H01H 13/7057; H01H 21/22; H01H 2003/466; H01H 21/285; H01H 3/46; H01H 13/20
See application file for complete search history.

(56) References Cited

FOREIGN PATENT DOCUMENTS

| | | | |
|---|---|---|---|
| TW | 201635320 | A | 10/2016 |
| TW | 201721695 | A | 6/2017 |

* cited by examiner

KEYBOARD DEVICE

CROSS-REFERENCE TO RELATED APPLICATION

This non-provisional application claims priority under 35 U.S.C. § 119(a) to Patent Application No. 107127515 filed in Taiwan, R.O.C. on Aug. 7, 2018, the entire contents of which are hereby incorporated by reference.

BACKGROUND

Technical Field

The instant disclosure relates to a computer peripheral device and, more particularly, to a keyboard device.

Related Art

Generally, a key structure of a keyboard mainly includes a key cap, a scissors connector, and a bottom plate. The scissors connector is assembled to a bottom of the key cap and a hook on the bottom plate to provide a function of supporting and guiding the key cap to move up and down.

Nonetheless, an assembling process of the scissors connector is complex and difficult, and the scissors connector occupies most of space under the key cap, which negatively impacts the installation of other components. In addition, regarding a keyboard of light emitting type, light rays generated by a backlight module have to pass through the bottom plate and the scissors connector to reach the key cap, which causes energy loss of light, and therefore the efficiency is poor.

SUMMARY

To address the above issue, an embodiment of the instant disclosure provides a keyboard device comprising a bottom plate, a plurality of key caps, a circuit board, a plurality of reset members, and a plurality of assembly structures. The bottom plate comprises an upper surface. The upper surface is provided with a plurality of assembly regions. The key caps are disposed above the bottom plate and respectively correspond to the assembly regions. The circuit board is disposed under the key caps. The reset members are respectively disposed between the bottom plate and the key caps. Each of the key caps is elastically abutted by each of the reset members. The assembly structures are respectively connected between the bottom plate and the key caps. Each of the assembly structures comprises an assembly member and a long rod. The assembly member is protruded on the corresponding assembly region. The long rod is mounted on the assembly member and is capable of moving up and down relative to the bottom plate. Each of the key caps comprises a clamp portion. The clamp portion is sleeved on the long rod. The key cap is connected to the bottom plate via the clamp portion and is swingable about the long rod relative to the bottom plate.

Concisely, according to the keyboard device of the embodiments of the instant disclosure, the key caps are assembled to the long rods of the assembly structures, and thus there is no need of scissors connector. The cost of the keyboard can be lowered, and the assembling process can be simplified. In addition, a usable space under the key caps can be increased, which is benefit to the installation of other components. Moreover, regarding the keyboard of light emitting type, lesser light rays are blocked, and thus the efficiency of light emitting can be improved.

DETAILED DESCRIPTION

Figure 1:
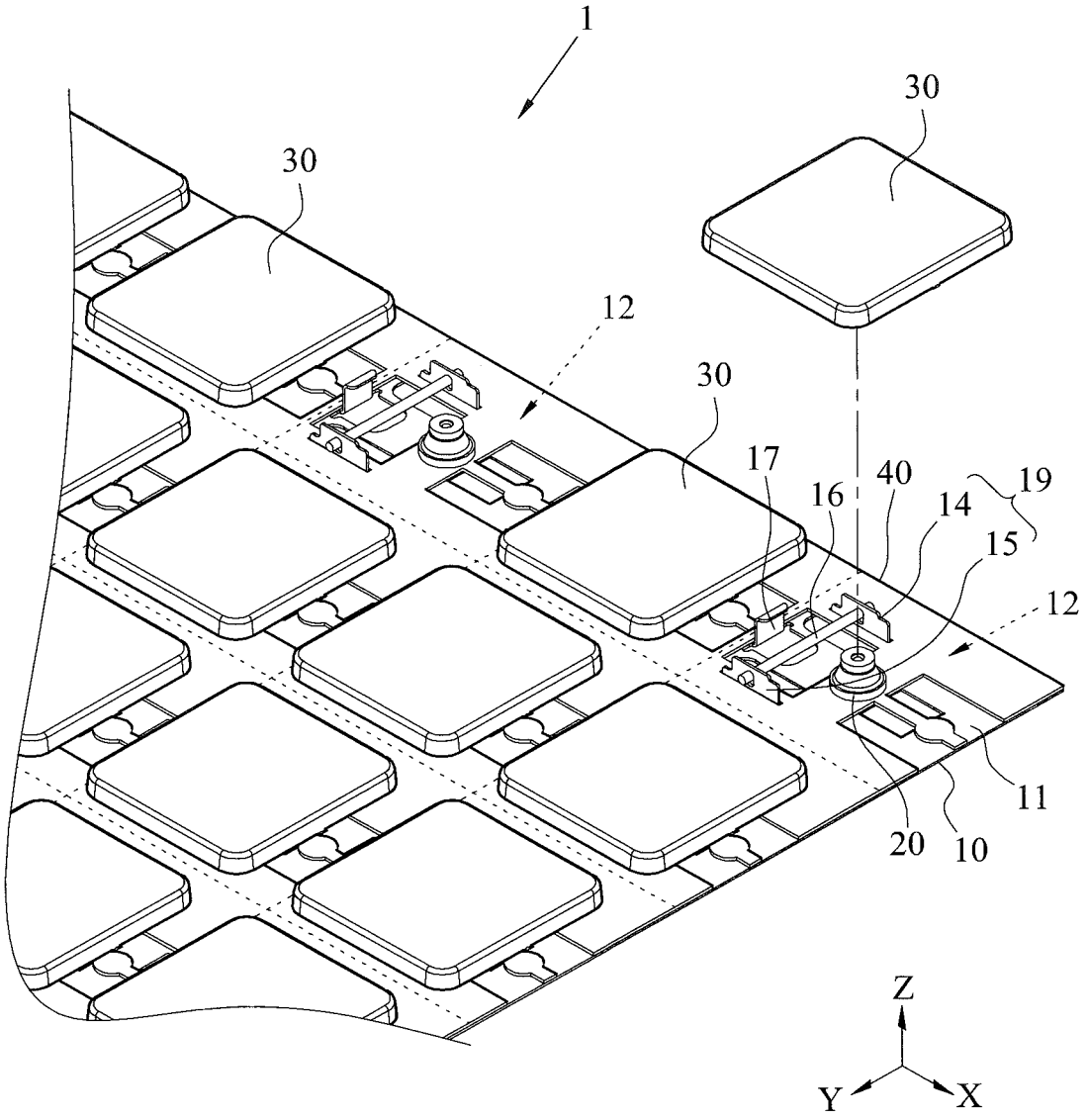
FIG. 1 illustrates a perspective view of a keyboard device according to an embodiment of the instant disclosure.
Figure 2:
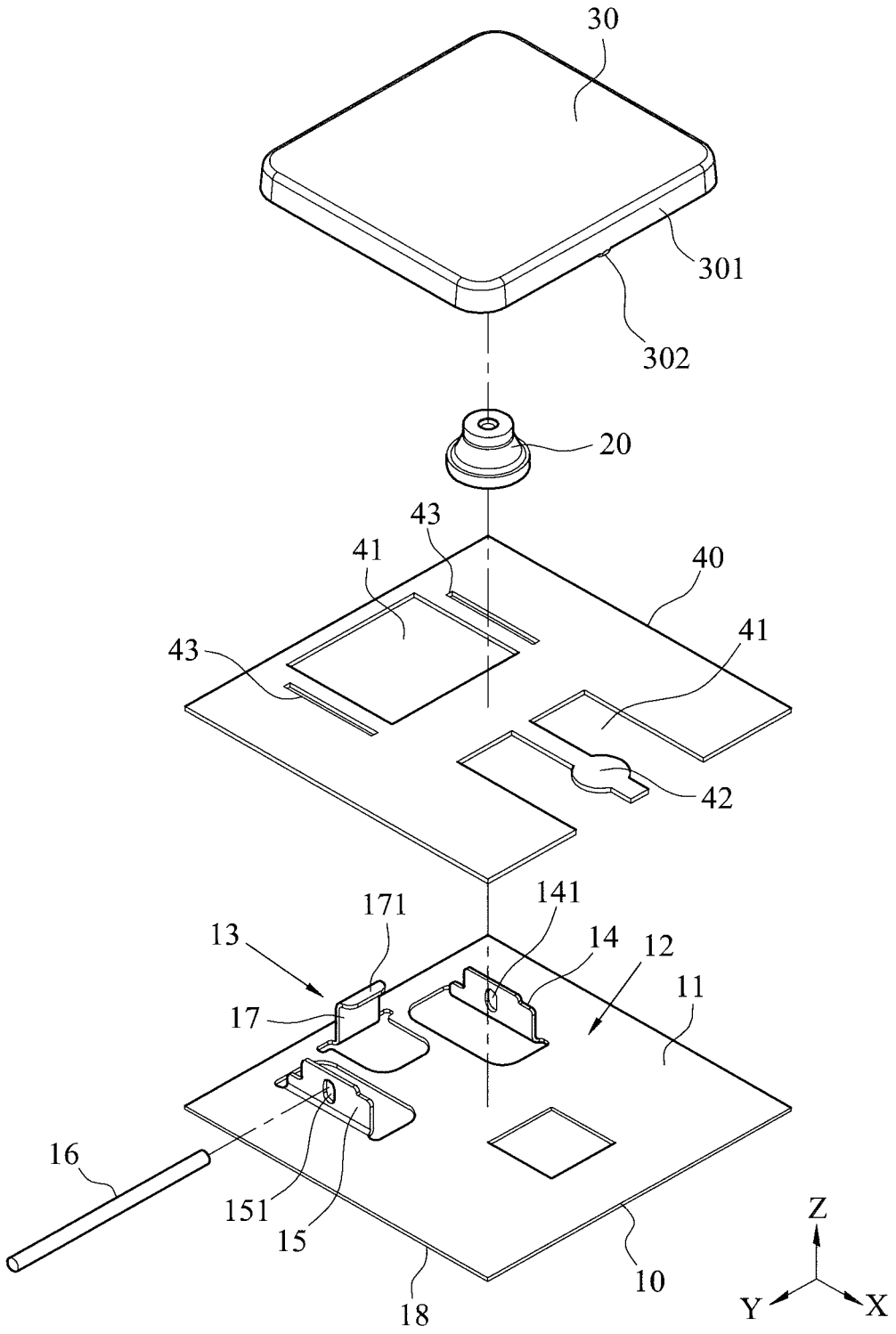
FIG. 2 illustrates a partially exploded view of the keyboard device according to an embodiment of the instant disclosure.
Figure 3:
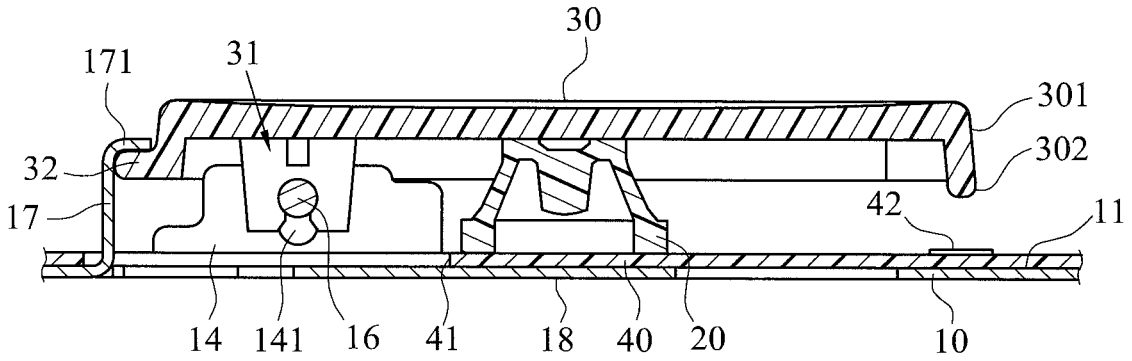
FIG. 3 illustrates a partially cross sectional view of the keyboard device according to an embodiment of the instant disclosure.

FIG. 1 is a perspective view of a keyboard device according to an embodiment of the instant disclosure. FIG. 2 is a partially exploded view of the keyboard device according to an embodiment of the instant disclosure. FIG. 3 is a partially cross sectional view of the keyboard device according to an embodiment of the instant disclosure. As shown in FIG. 1 and FIG. 2, the keyboard device 1 of the embodiment comprises a bottom plate 10, a plurality of reset members 20, a plurality of key caps 30, and a circuit board 40. Wherein, the circuit board 40 is disposed above the bottom plate 10. The key caps 30 are disposed above the circuit board 40. The reset members 20 are respectively disposed between the key caps 30 and the circuit board 40.

As shown in FIG. 1 and FIG. 2, the bottom plate 10 may be a solid plate body made by metal (e.g., aluminum, steel, or alloy) or plastic materials for supporting components. The bottom plate 10 comprises an upper surface 11 and a lower surface 18 opposite to each other. The upper surface 11 is provided with a plurality of assembly regions 12. The assembly regions 12 are regions (e.g., grid regions defined by dotted lines in FIG. 1) on the bottom plate 10 to which the key caps 30 are correspondingly assembled. Each of the assembly regions 12 of the bottom plate 10 is provided with an assembly structure 13 to which the key caps 30 are respectively correspondingly assembled.

As shown in FIG. 1 and FIG. 2, the assembly structure 13 on each of the assembly regions 12 comprises an assembly member 19 and a long rod 16. Wherein, the long rod 16 is mounted on the assembly member 19 and is capable of moving up and down relative to the bottom plate 10. For example, in the embodiment, the assembly member 19 comprises a first stand board 14 and a second stand board 15 spaced from each other. Wherein, the first stand board 14 and the second stand board 15 are upwards protruded on the first surface 11 of the bottom plate 10. In the embodiment, the first stand board 14 and the second stand board 15 are boards which are integrally bent and extend from the bottom plate 10 upwards (e.g., being formed in one piece in a bending and stamping process). The first stand board 14 and the second stand board 15 are parallel with each other. In the embodiment, the first stand board 14 and the second stand board 15 are parallel with X axis and are spaced from each other in Y direction. The first stand board 14 and the second stand board 15 are close to a side of the corresponding assembly region 12. In other embodiments, the first stand board 14 and the second stand board 15 may also be, but not limited to, assembled to the bottom plate 10 (e.g., in adhering, soldering, or coupling manner).

As shown in FIG. 2, the circuit board 40 is opened with two through holes 43 corresponding to the first stand board 14 and the second stand board 15. The first stand board 14 and the second stand board 15 pass through the two through holes 43 upwards and are protruded on a surface of the circuit board 40. In addition, the first stand board 14 is provided with a first long slot 141, and the second stand board 15 is provided with a second long slot 151. In the embodiment, the first long slot 141 and the second long slot 151 extend vertically (e.g., extending along Z direction in FIG. 2) and correspond to each other in the same level. In some embodiments, the first long slot 141 and the second stand board 15 may be, but not limited to, formed in a punching process.

As shown in FIG. 1 and FIG. 2, the long rod 16 of the assembly structure 13 on each of the assembly regions 12 may be a circular, long rod body made by metal or plastic materials. The long rod 16 passes through and is disposed in the corresponding first long slot 141 of the first stand board 14 and the corresponding second long slot 151 of the second stand board 15. As shown in FIG. 2, in the embodiment, the long rod 16 passes through and is disposed in the corresponding first long slot 141 and the corresponding second long slot 151 along Y direction, and the long rod 16 is capable of sliding up and down along the first long slot 141 and the second long slot 151 to be close to or away from the bottom plate 10. For example, in the figure, the long rod 16 is capable of sliding up and down relative to the bottom plate 10 along Z direction and is restricted by the first long slot 141 and the second long slot 151, such that the long rod 16 is hard to be detached therefrom. In addition, two ends of the long rod 16 are not fixed; therefore, the long rod 16 is also rotatable relative to the first long slot 141 and the second long slot 151.

As shown in FIG. 1 and FIG. 2, the assembly structure 13 further comprises a hook member 17. Wherein, the hook member 17 is between the first stand board 14 and the second stand board 15 and is on a side of the long rod 16. A top of the hook member 17 is provided with a hook portion 171. In the embodiment, the hook member 17 is a board which is integrally bent and extends from the bottom plate 10 upwards (e.g., being formed in one piece in a bending and stamping process). The hook portion 171 is a bent board which is bent by the top of the hook member 17 towards the long rod 16. The hook member 17, the first stand board 14, and the second stand board 15 are close to a same side of the corresponding assembly region 12. In other embodiments, the hook member 17 may also be, but not limited to, assembled to the bottom plate 10 (e.g., in adhering, soldering, or coupling manner).

As shown in FIG. 1 and FIG. 2, the reset members 20 are respectively disposed in each of the assembly regions 12 of the bottom plate 10. For example, the reset member 20 may be adhered to and fixed to a surface of the corresponding assembly region 12. The reset member 20 in each of the assembly regions 12 and the hook member 17 are respectively on two opposite sides of the long rod 16. In the embodiment, the reset member 20 in each of the assembly regions 12 is disposed on a central region of the corresponding assembly region 12. The long rod 16 and the hook member 17 are on a same side of the reset member 20. In some embodiments, each of the reset members 20 is, but not limited to, a rubber body (e.g., a rubber dome), a mechanical switch, or a spring sheet (e.g., a metal spring sheet).

As shown in FIG. 1 to FIG. 3, the key caps 30 are disposed above the bottom plate 10 and the circuit board 40 and respectively correspond to the assembly regions 12. Each of the key caps 30 is provided with a clamp portion 31 and a blocking member 32. The clamp portion 31 is at a bottom of the key cap 30. The blocking member 32 is at a side of the key cap 30. Wherein, the clamp portion 31 is sleeved on the long rod 16. The blocking member 32 abuts against the hook portion 171 of the hook member 17. The reset member 20 elastically abuts the bottom of the key cap 30. In the embodiment, the reset member 20 elastically abuts a center of the bottom of the key cap 30 to have the key cap 30 stay in a preset level. It is not limited to the above embodiment. The reset member 20 may elastically abut other parts of the bottom of the key cap 30.

As shown in FIG. 3, in the embodiment, the clamp portion 31 of the key cap 30 is a coupler to be correspondingly sleeved on an external of the corresponding long rod 16. Whereby while the key cap 30 swings relative to the bottom plate 10, the key cap 30 may rotate relative to the long rod 16, or the key cap 30 may simultaneously drive the long rod 16 to rotate in the first long slot 141 and the second long slot 151. The blocking member 32 is a board which integrally extends from a side of the key cap 30. In the embodiment, the blocking member 32 is under the hook portion 171 of the hook member 17. Since the reset member 20 elastically abuts against the key cap 30 upwards, the blocking member 32 is capable of abutting against the hook portion 171 for coupling and restricting. The operation of the keyboard device 1 according to the embodiment of the instant disclosure is further illustrated with the drawings as follows.

Figure 4:
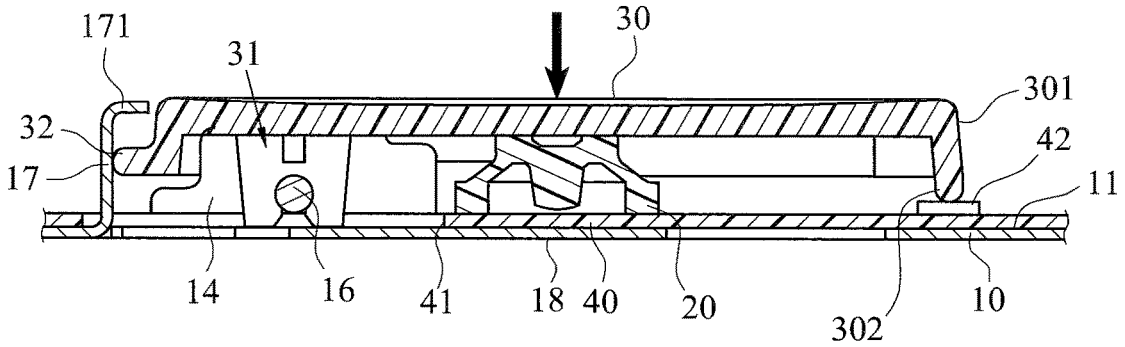
FIG. 4 illustrates a schematic diagram of operation of the keyboard device according to an embodiment of the instant disclosure.

Please refer to FIG. 3 and FIG. 4. In the embodiment, a side of each of the key caps 30 is further downwards protruded with a trigger block 302. The key cap 30 has a side 301 away from the hook member 17. The trigger block 302 integrally extends, but not limited to, from the side 301 downwards. The trigger block 302 may also extend from other sides of the key cap 30 downwards. The circuit board 40 may comprise a plurality of circuit trigger portions 42. For example, the circuit board 40 may be laid out with conductive lines (not shown in the figure). Each of the circuit trigger portions 42 is connected to a corresponding conductive contact of the conductive lines. Each of the circuit trigger portions 42 of the circuit board 40 respectively corresponds to the trigger block 302 of each of the key caps 30. While a user presses a center of the key cap 30 downwards, the key cap 30 is downwards against the reset member 20, such that the reset member 20 is compressed and restores elastic force, and the long rod 16 is driven to slide down along the first long slot 141 and the second long slot 151. Thus the key cap 30 can evenly move down (as shown in FIG. 4) to have the trigger block 302 be correspondingly against the circuit trigger portion 42 to trigger the conductive lines of the circuit board 40 and generate a corresponding signal. While the user releases the key cap 30, the reset member 20 abuts against the key cap 30 and moves the key cap 30 up. The key cap 30 is able to drive the long rod 16 to slide up along the first long slot 141 and the second long slot 151 and to have the trigger block 302 detached from the circuit trigger portion 42. In addition, while the blocking member 32 of the key cap 30 abuts against the hook portion 171 of the hook member 17, and the long rod 16 is upwards against the first stand board 14 and the second stand board 15, the key cap 30 can be restricted in the preset level and prevented from detaching.

In some embodiments, the circuit board 40 may be, but not limited to, a general printed circuit board (PCB), a flexible printed circuit board (FPCB), or a rigid-flex PCB.

Figure 5:
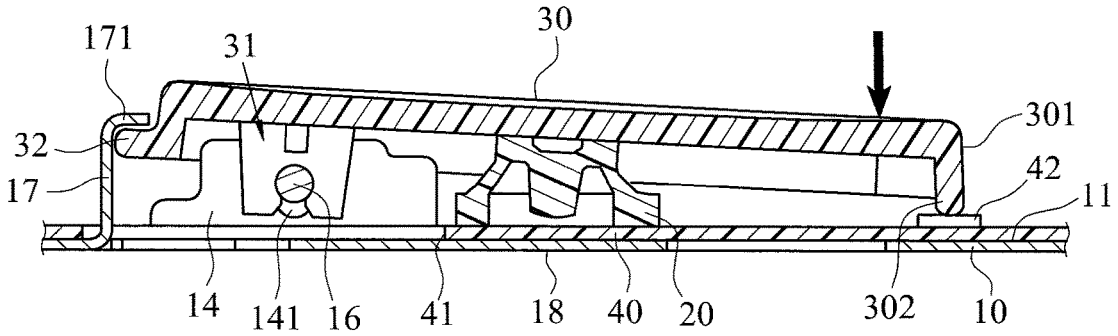
FIG. 5 illustrates a schematic diagram of operation of the keyboard device according to another embodiment of the instant disclosure.

Please refer to FIG. 3 and FIG. 5. While a user presses a side of the key cap 30 downwards (e.g., as shown in FIG. 5, the side of the key cap 30 away from the hook member 17 and provided with the trigger block 302 is pressed in the example), the key cap 30 swings about the long rod 16 (swinging clockwise in FIG. 5) to have the pressed side of the key cap 30 approach the circuit board 40. The trigger block 302 is correspondingly against the circuit trigger portion 42 of the circuit board 40 to trigger the conductive lines of the circuit board 40 to generate the corresponding signal. In addition, the key cap 30 is simultaneously downwards against the reset member 20, such that the reset member 20 is compressed and restores elastic force. The blocking member 32 of the key cap 30 opposite to the pressed side continuously abuts against the hook portion 171 of the hook member 17 for coupling and restricting. While the user releases the key cap 30, the reset member 20 abuts against the key cap 30 and moves the key cap 30 up to have the key cap 30 swing about the long rod 16 to return to an initial position (as shown in FIG. 3). The trigger block 302 is detached from the circuit trigger portion 42 of the circuit board 40. In addition, since the hook member 17 is integrally bent and extends from the bottom plate 10 upwards, the hook portion 171 of the hook member 17 may provide downwards elastic force to facilitate the key cap 30 returning to the initial position while the blocking member 32 is upwards against the hook portion 171.

Concisely, according to the keyboard device 1 of the embodiments of the instant disclosure, the key caps 30 are assembled to the long rods 16 of the assembly structures 13 to be connected to the bottom plate 10. Comparing to conventional keyboards, there is no need of scissors connector for the keyboard device 1 of the embodiments. The cost of the keyboard can be lowered, and the assembling process can be simplified. In addition, the usable space under the key caps 30 is increased, which is benefit to the installation of other components. Regarding the keyboard of light emitting type, lesser light rays are blocked, and thus the efficiency of light emitting can be improved. For example, as shown in FIG. 2, the circuit board 40 is opened with a plurality of light through holes 41. Since the keyboard device 1 of the embodiments of the instant disclosure has no need of scissors connector, light rays will not be blocked by components while passing through the light through holes 41 upwards. The quantity of light transmitted through the key caps 30 can be increased.

The embodiments of the instant disclosure have more advantages other than those described above. The structural design that the long rod 16 passes through and is disposed in the first long slot 141 of the first stand board 14 and the second long slot 151 and the second stand board 15 and can rotate or move up and down relative to the first long slot 141 and the second long slot 151 provides the key cap 30 two different press modes. For example, a vertical up-and-down press mode as shown in FIG. 4, and a piano-like press mode as shown in FIG. 5. Different press modes can provide users with different feelings of pressing.

Figure 6:
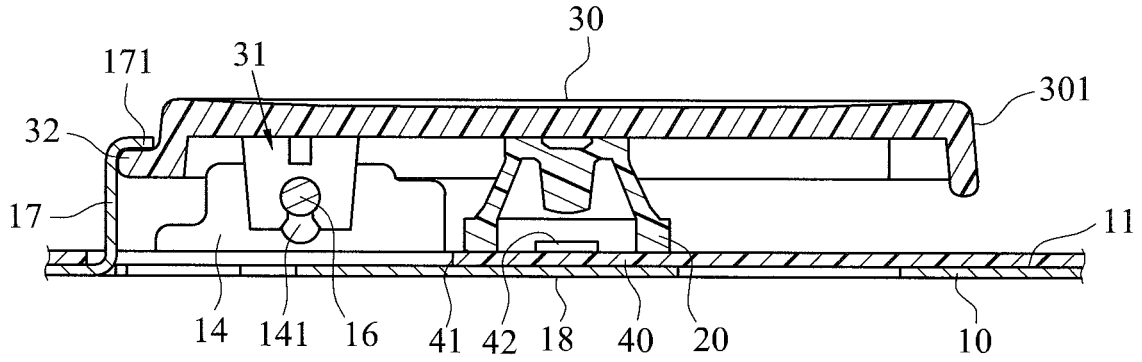
FIG. 6 illustrates a partially cross sectional view of the keyboard device according to another embodiment of the instant disclosure.

In another embodiment, as shown in FIG. 6, each of the circuit trigger portions 42 of the circuit board 40 may also respectively correspond to a bottom of each of the reset members 20. While the key cap 30 is pressed and moves down, the reset member 20 is compressed and abuts against the circuit trigger portions 42 downwards to trigger the conductive lines of the circuit board 40 to generate the corresponding signal. Alternatively, in some embodiments, the circuit board 40 may have two circuit trigger portions 42 in each of the assembly regions 12. One of the circuit trigger portions 42 corresponds to the bottom of the reset member 20, and the other one of the circuit trigger portions 42 corresponds to the trigger block 302 on the side 301 of the key cap 30. As a result, whether the key cap 30 adopts the vertical up-and-down press mode or the piano-like press mode, it is ensured that at least one of the circuit trigger portions 42 of the circuit board 40 can be triggered and the corresponding signal can be generated. The above embodiment is not shown in the figure.

Figure 7:
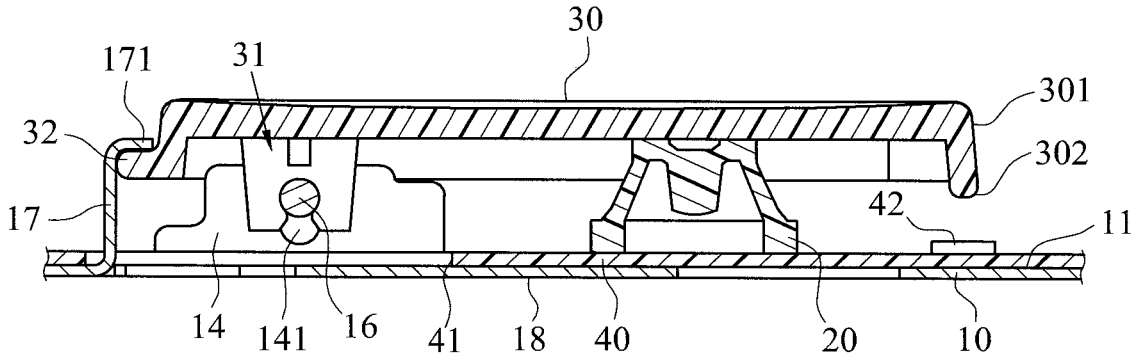
FIG. 7 illustrates a partially cross sectional view of the keyboard device according to yet another embodiment of the instant disclosure.

As shown in FIG. 7, in an embodiment, a position that the reset member 20 abuts against the key cap 30 may be close to the trigger block 302. In the embodiment, the side 301 of the key cap 30 is away from the hook member 17 and is provided with the trigger member 302. The reset member 20 abuts against a region of a part of the bottom of the key cap 30 close to the trigger block 302. Under the circumstances, an idle travel can be decreased while the side of the key cap 30 is pressed (as shown in FIG. 5).

While the instant disclosure has been described by way of example and in terms of the preferred embodiments, it is to be understood that the instant disclosure needs not be limited to the disclosed embodiments. For anyone skilled in the art, various modifications and improvements within the spirit of the instant disclosure are covered under the scope of the instant disclosure. The covered scope of the instant disclosure is based on the appended claims.

What is claimed is:

1. A keyboard device, comprising:

a bottom plate comprising an upper surface, the upper surface being provided with a plurality of assembly regions;

a plurality of key caps disposed above the bottom plate and respectively corresponding to the assembly regions;

a circuit board disposed under the key caps;

a plurality of reset members respectively disposed between the bottom plate and the key caps, each of the key caps being elastically abutted by each of the reset members; and a plurality of assembly structures respectively connected between the bottom plate and the key caps, each of the assembly structures comprising an assembly member and a long rod, the assembly member being protruded on the corresponding assembly region, the long rod being mounted on the assembly member and being capable of moving up and down relative to the bottom plate;

wherein, each of the key caps comprises a clamp portion, the clamp portion is sleeved on the long rod, and the key cap is connected to the bottom plate via the clamp portion and is swingable about the long rod relative to the bottom plate.

2. The keyboard device of claim 1, wherein the long rod is rotatably connected to the assembly member.

3. The keyboard device of claim 1, wherein the clamp portion of each of the key caps is rotatably sleeved on the long rod.

4. The keyboard device of claim 2, wherein the assembly member comprises a first stand board and a second stand board protruded on the corresponding assembly region, the first stand board and the second stand board are spaced from each other, and the corresponding long rod is mounted on the first stand board and the second stand board and is capable of moving up and down relative to the bottom plate.

5. The keyboard device of claim 4, wherein the first stand board is provided with a first long slot, the second stand board is provided with a second long slot, and the corresponding long rod passes through and is disposed in the first long slot and the second long slot.

6. The keyboard device of claim 4, wherein the first stand board and the second stand board are integrally bent and extend from the bottom plate.

7. The keyboard device of claim 1, wherein each of the assembly structures further comprises a hook member, a side of each of the key caps is provided with a blocking member, and the blocking member abuts against the hook member.

8. The keyboard device of claim 7, wherein the hook member is integrally bent and extends from the bottom plate.

9. The keyboard device of claim 1, wherein each of the reset members elastically abuts a center of each of the key caps.

10. The keyboard device of claim 1, wherein the circuit board comprises a plurality of circuit trigger portions, and the circuit trigger portions respectively correspond to bottoms of the reset members.

11. The keyboard device of claim 1, wherein the circuit board comprises a plurality of circuit trigger portions, a side of each of the key caps is further protruded with a trigger block, and the trigger blocks of the key caps respectively correspond to the circuit trigger portions.

12. The keyboard device of claim 11, wherein each of the reset members is close to the trigger block of each of the key caps.

13. The keyboard device of claim 1, wherein each of the reset members is a rubber body, a mechanical switch, or a spring sheet.

* * * * *